United States Patent [19]

Houck

[11] 4,155,496

[45] May 22, 1979

[54] WEB CONTROL DEVICE

[75] Inventor: Stanley J. Houck, Akron, Ohio

[73] Assignee: The Goodyear Tire & Rubber Company, Akron, Ohio

[21] Appl. No.: 881,343

[22] Filed: Feb. 27, 1978

[51] Int. Cl.[2] ..... B65H 25/26

[52] U.S. Cl. ..... 226/16; 226/21; 226/197

[58] Field of Search ..... 226/16, 18, 21-23, 226/197, 15

[56] References Cited

U.S. PATENT DOCUMENTS 3,434,639 3/1969 Cowles ..... 226/21

FOREIGN PATENT DOCUMENTS 753481 7/1956 United Kingdom ..... 226/18

*Primary Examiner*—Robert J. Spar
*Assistant Examiner*—H. Grant Skaggs
*Attorney, Agent, or Firm*—R. S. Washburn

[57] ABSTRACT

A device for direction control of a moving web includes a turning bar having a variable spaced drive the rotation speed of which is responsive to a sensor to correct deviations of the web from its intended path.

2 Claims, 1 Drawing Figure

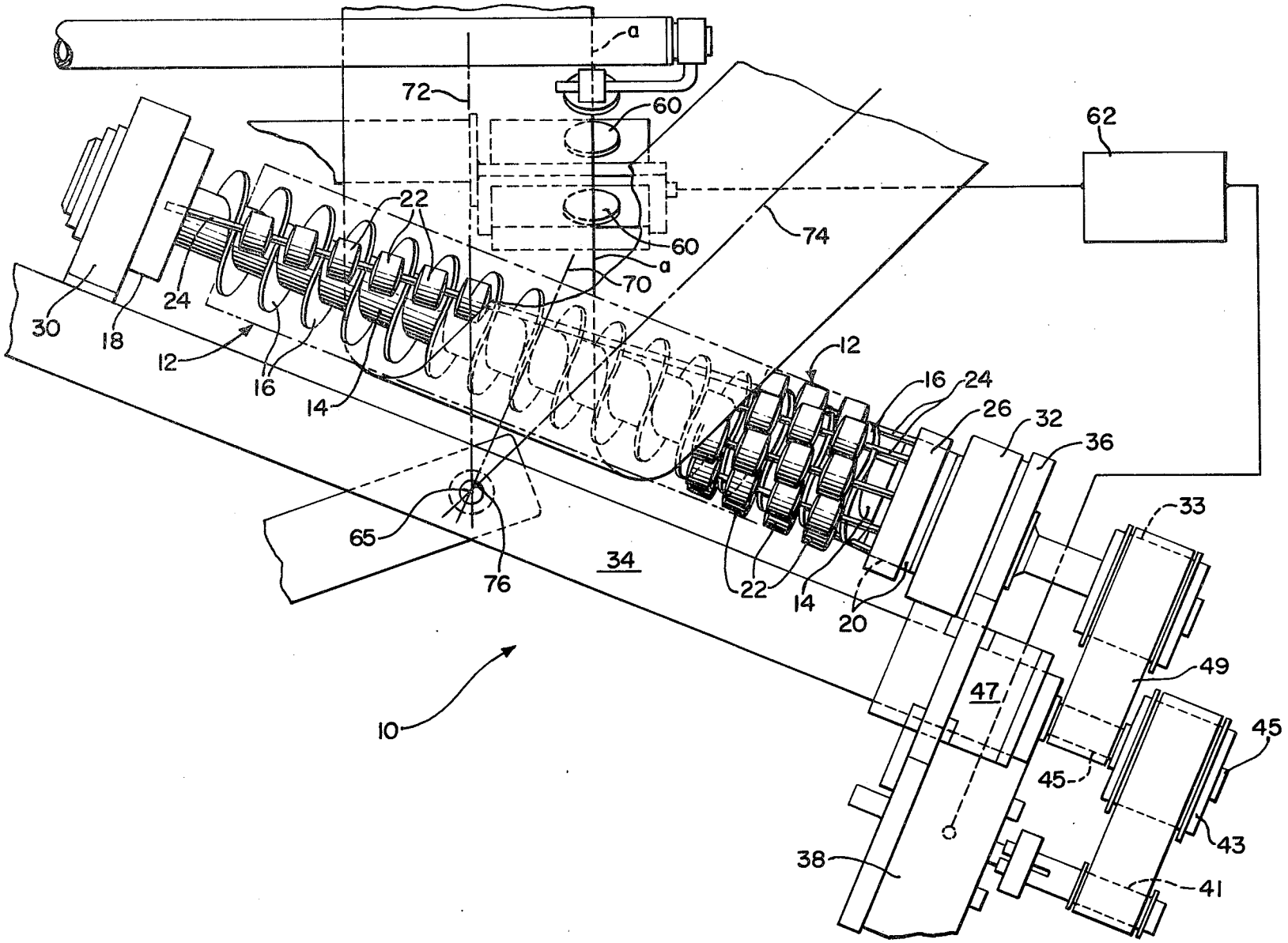
62
33
49
45
43
41
36
32
26
24
16
12
20
14
22
47
38
74
60
a
70
34
76
72
65
10
18
30

WEB CONTROL DEVICE

The invention relates to a web control device and particularly to turning bar means for turning a running length web moving thereover angularly from a first direction coming to the turning bar means to a second direction going away from said means.

It is often convenient and sometimes necessary in handling a running length web of material to arrange the direction of the web coming from supply means, such as an unwinding roll, otherwise than in planar alignment with the means receiving such web for rewinding or for further processing. This problem has long been known and has brought forth many proposed solutions. It is also known that the change of direction of movement cannot satisfactorily be accomplished by plane cylindrical rotatable rolls commonly used to conduct running length webs along two dimensional paths. Heretofore, turning bars for changing the direction of movement of running length web have been provided as stationary cylindrical surfaces fixed at suitable angles with respect to the oncoming web which angles are generally fixed at one-half of the angle desired between the oncoming and the offgoing web relative to the turning bar. Such turning bars have been provided with a variety of means for reducing the surface friction between the web and the turning bar.

Practical operating experience with turning bar devices of all kinds has demonstrated that such turning bars must be fixed precisely with respect to the oncoming and offgoing directions of the web running thereover. I have discovered that by providing variable speed drive means connected to rotate turning bar means at a surface speed variable with respect to the surface speed of the web moving over the turning bar means, deviations from the normal direction of the oncoming web or irregularities in the tension of the web can be effectively corrected so that the turning bar means itself controls the direction and lateral position of the offgoing web in its desired path.

Broadly stated, the objects of my invention are accomplished by a web control device comprising turning bar means for turning a web moving thereover angularly from a first direction coming to the turning bar means to a second direction going from said means, said turning bar means including a rotatable shaft having a single helical thread thereon extending in a plurality of turns along a portion of the shaft length at least equal to the width of said web, a plurality of freely rotatable rolls of cylinder shape disposed rotatably about parallel helical rotation axes extending perpendicularly of said helical thread and closely spaced helically about said shaft throughout said turns so as collectively to define a generally cylindrical web-supporting surface, variable speed drive means for rotating said shaft about its longitudinal axis in a continuous range of surface speeds differing from the surface speed of the movement of the web thereover, sensing means for sensing the lateral deviations of said web coming to said turning bar means with respect to a predetermined lateral path location, and control means responsive to deviation sensed by said sensing means for controlling said variable speed drive means to increase or decrease the rotational surface speed of said shaft so as to reduce said lateral deviation.

To acquaint persons skilled in the arts most closely related to the present invention, certain preferred embodiments thereof illustrating a best mode now contemplated for putting the invention into practice are described herein by and with reference to the annexed drawings forming a part of the specification. The embodiments shown and described herein are illustrative and as will become apparent to those skilled in these arts can be modified in numerous ways within the spirit and scope of the invention defined in the claims hereof.

In the drawing a web control device in accordance with the invention is illustrated.

The web control device 10 shown in the drawing includes turning bar means 12 which includes a rotatable shaft 14 having a single helical thread 16 thereon which extends in a plurality of turns along the length of the shaft 14 between the hubs 18 and 20. A generally cylindrical web-supporting surface is provided by a multiplicity of small rollers 22. The rollers 22 are each rotatable about rotation axes provided by a plurality of rods 24 which extend also helically and respectively perpendicular to the helical thread 16. The rods 24 are accommodated in sockets provided in the hub 18 and are secured in respective grooves in the hub 20 by clamps 26. Each of the rods 24 is accommodated in a series of notches formed in the helical thread 16 and in which the several rods 24 are disposed to provide parallel rotation axes for the rolls 22. The shaft 14 is journalled in bearings contained in the respective housings 30 and 32, the shaft end projecting through the housing 32 having a belt pulley 33 corotatably fixed thereon.

The bearing housings 30 and 32 are fixed rigidly to any suitable frame such as the beam 34, to which is connected the end plate 36 which also provides support for the variable speed motor 38.

The variable speed drive means for rotating the shaft 14 about its own longitudinal axis is provided by the variable speed motor 38 and, in the present device, includes a two-stage drive belt speed reduction whereby the available rotational speed range of the motor 38 is adapted to provide the desired variable surface speed of the turning bar means. A pulley 41 fixed to the motor output shaft is connected by a drive belt to a larger pulley 43 mounted on an intermediate shaft 45 carried in bearing housing 47 fixed on the frame 34. A second drive belt 49 drivingly connects the smaller pulley on intermediate shaft 45 to the larger pulley 33 mounted corotatably on the shaft 14.

Sensing means for sensing deviations laterally of the intended path of the oncoming web portion are provided by conventional photocell web edge detector 60 which provides signals representative respectively of a deviation of the web edge a toward the left or of a deviation of the edge a toward the right. The respective signals are communicated from the photocell detector 60 to conventional control means 62 which control means is responsive to the signals from the photocell detector 60. Control means 62 operates in response to signals from the sensing means to increase or to decrease the speed of the variable speed motor 38 which, through the two-stage reduction drive, increases or decreases the surface speed of the shaft 14, so as to reduce the lateral deviation and thereby to maintain the edge a of the oncoming web at its desired lateral position.

It should be noted that one of the particular advantages of the device according to the invention is that the frame 34 can be mounted for pivotal movement around a pivot axis 65 which preferably is located along and perpendicular to the bisecting line 70 which bisects the included angle formed between the centerline 72 of the oncoming web and the centerline 74 of the offgoing web and preferably at the vertex 76 of such angle. Suitable means, not shown, are then required to fix the position to which the turning bar means 12 is adjusted.

While certain representative embodiments and details have been shown for the purpose of illustrating the invention, it will be apparent to those skilled in the art that various changes and modifications may be made therein without departing from the spirit or scope of the invention.

What is claimed is:

1. Web control device comprising turning bar means for turning a web moving thereover angularly from a first direction coming to the turning bar means to a second direction going from said means, said turning bar means including a rotatable shaft having a single helical thread thereon extending in a plurality of turns along a portion of the shaft length at least equal to the width of said web, a plurality of freely rotatable rolls of cylinder shape disposed rotatably about parallel helical rotation axes extending perpendicularly of said helical thread and closely spaced helically about said shaft throughout said turns so as collectively to define a generally cylindrical web-supporting surface, variable speed drive means for rotating said shaft about its longitudinal axis in a continuous range of surface speeds differing from the surface speed of the movement of the web thereover, sensing means for sensing the lateral deviations of said web coming to said turning bar means with respect to a predetermined lateral path location, and control means responsive to deviation sensed by said sensing means for controlling said variable speed drive means to increase or decrease the rotational surface speed of said shaft so as to reduce said lateral deviation.

2. Web control device as claimed in claim 1, further comprising a frame supporting said shaft for rotation about its own longitudinal axis, and pivot means providing a pivoting axis for said frame, said axis extending perpendicularly with the line bisecting the centerline of the oncoming web and the centerline of the offgoing web, said pivot means enabling the longitudinal orientation of said turning bar means to accommodate a selected angle between the oncoming direction of the web coming on to the turning bar means and the direction of the web going off the turning bar means.

* * * * *